US008414336B2

(12) United States Patent
Yu et al.

(10) Patent No.: US 8,414,336 B2
(45) Date of Patent: Apr. 9, 2013

(54) CABLE END CONNECTOR

(75) Inventors: Wang-I Yu, Jhonghe (TW); Chin-Li Wang, Jhonghe (TW); Yung-Chih Hung, Jhonghe (TW); Min-Shan Kao, Jhonghe (TW)

(73) Assignee: Alltop Electronics (Suzhou) Co., Ltd, Taicang (CN)

( * ) Notice: Subject to any disclaimer, the term of this patent is extended or adjusted under 35 U.S.C. 154(b) by 44 days.

(21) Appl. No.: 13/109,303

(22) Filed: May 17, 2011

(65) Prior Publication Data

US 2012/0258631 A1 Oct. 11, 2012

(30) Foreign Application Priority Data

Apr. 8, 2011 (CN) ..... 2011 1 0088114

(51) Int. Cl.
*H01R 24/00* (2006.01)

(52) U.S. Cl.
USPC ..... 439/660

(58) Field of Classification Search ..... 439/660, 439/357, 852, 758, 748, 721, 701, 630, 709
See application file for complete search history.

(56) References Cited

U.S. PATENT DOCUMENTS

| | | | | | |
|---|---|---|---|---|---|
| 3,760,335 | A * | 9/1973 | Roberts | 439/398 |
| 4,351,579 | A * | 9/1982 | Kordes et al. | 439/497 |
| 4,392,707 | A * | 7/1983 | Holce et al. | 439/573 |
| 4,556,765 | A * | 12/1985 | Shaw et al. | 200/61.71 |
| 4,669,806 | A * | 6/1987 | Fuchs | 439/712 |
| 4,732,566 | A * | 3/1988 | Martucci | 439/106 |
| 5,460,542 | A * | 10/1995 | Castellani et al. | 439/535 |
| 6,053,780 | A * | 4/2000 | Ono et al. | 439/810 |
| 7,029,336 | B2 * | 4/2006 | Cox | 439/709 |
| 7,559,810 | B1 * | 7/2009 | Wu | 439/801 |
| 7,632,148 | B1 * | 12/2009 | Kawamura et al. | 439/607.41 |
| 7,909,633 | B1 * | 3/2011 | Miller et al. | 439/441 |
| 8,105,118 | B2 * | 1/2012 | Claprood, Jr. | 439/709 |
| 8,206,182 | B2 * | 6/2012 | Kuo et al. | 439/676 |
| 8,221,167 | B2 * | 7/2012 | Kuo et al. | 439/660 |

* cited by examiner

*Primary Examiner* — Alexander Gilman
(74) *Attorney, Agent, or Firm* — Sughrue Mion, PLLC

(57) ABSTRACT

A cable end connector includes an insulative housing defines a number of contact-receiving passages penetrating therethrough, a number of conductive contacts received in the insulative housing and respectively received in the contact-receiving passages and each conductive contact including a contacting portion and a locking portion, a number of cable terminals respectively electrically connecting with the locking portion of the conductive contacts, a number of fastening members fastening the cable terminals with the conductive contacts, and a number of wires respectively electrically connecting with the cable terminals.

10 Claims, 6 Drawing Sheets

CABLE END CONNECTOR

BACKGROUND OF THE INVENTION

1. Field of the Invention

The present invention relates to an electrical connector, more particularly to a cable end connector electrically connecting with a cable.

2. Description of Related Art

Contacts of a conventional cable end connector are of sheet cutter shape and connect with cable terminals by rivet joint or other tight cooperation means. However, the conductive performance of the contacts is easily influenced by contacting area between the contacts and the cable terminals. Impedance is also easily to be generated and even to produce heat. It is apparent that the generated heat could cause a temperature increase of the cable end connector, and then decreases the safety of the cable end connector. In addition, when the sheet cutter shape contacts and the cable terminals cooperate with each other by tight cooperation means, it is prone to separating from each other if the cables are pulled unintentionally. Hence, the reliability of the product is decreased, even the whole system function is possible to be influenced.

Hence, it is necessary to improve the conventional cable end connector to address problems mentioned above.

BRIEF SUMMARY OF THE INVENTION

Accordingly, an object of the present invention is to provide a cable end connector which is of simple structure, easy to be assembled, and of high reliability.

In order to achieve the above-mentioned object, a cable end connector in accordance with the present invention comprises an insulative housing comprising a main portion and a mating portion extending forwardly from the main portion, the insulative housing defining a plurality of contact-receiving passages penetrating the main portion and the mating portion, a plurality of conductive contacts received in the insulative housing and respectively received in the contact-receiving passages and each conductive contact comprising a contacting portion and a locking portion, a plurality of cable terminals respectively electrically connecting with the locking portion of the conductive contacts, a plurality of fastening members fastening the cable terminals with the conductive contacts, and a plurality of wires respectively electrically connecting with the cable terminals.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
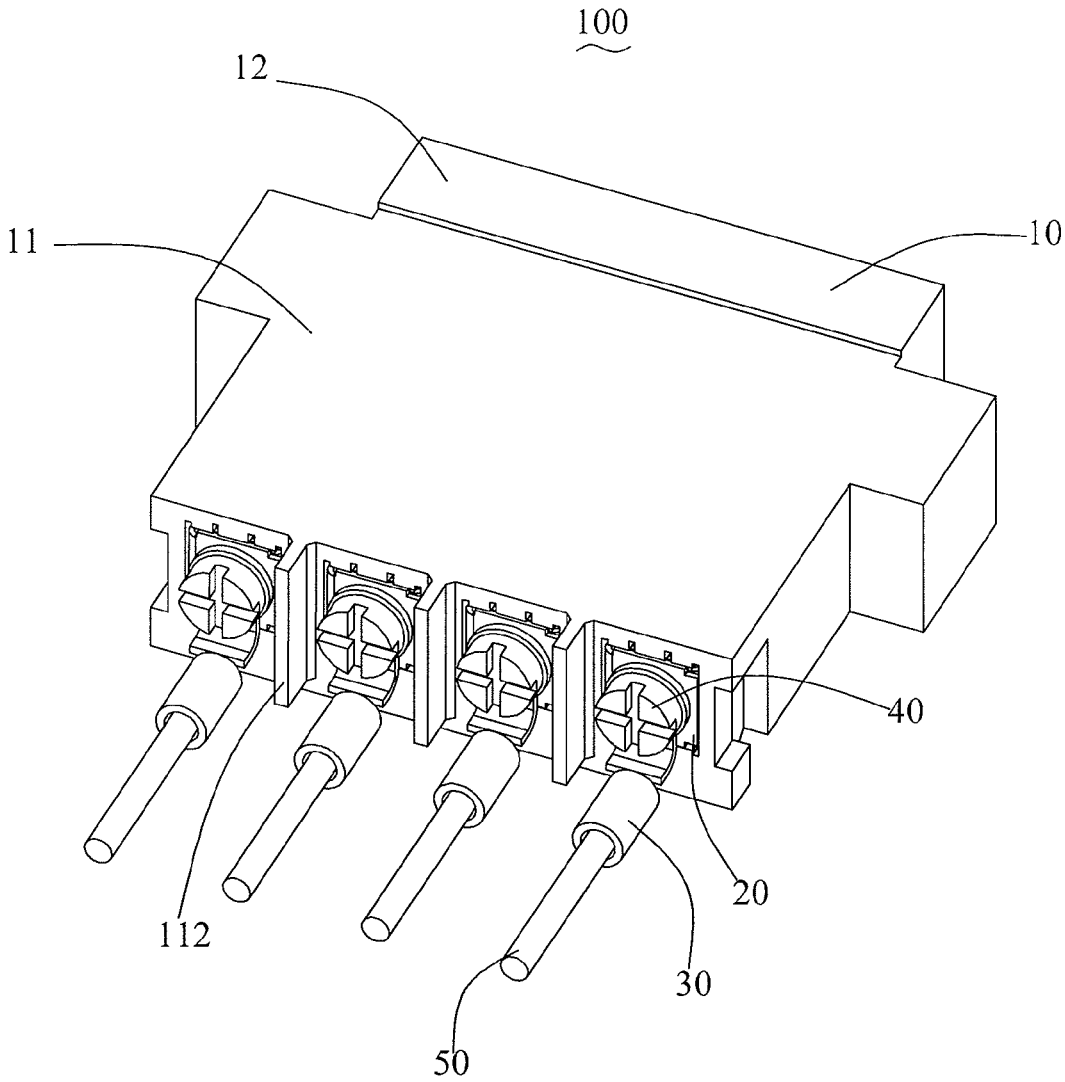
FIG. 1 is an assembled, perspective view of a cable end connector in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
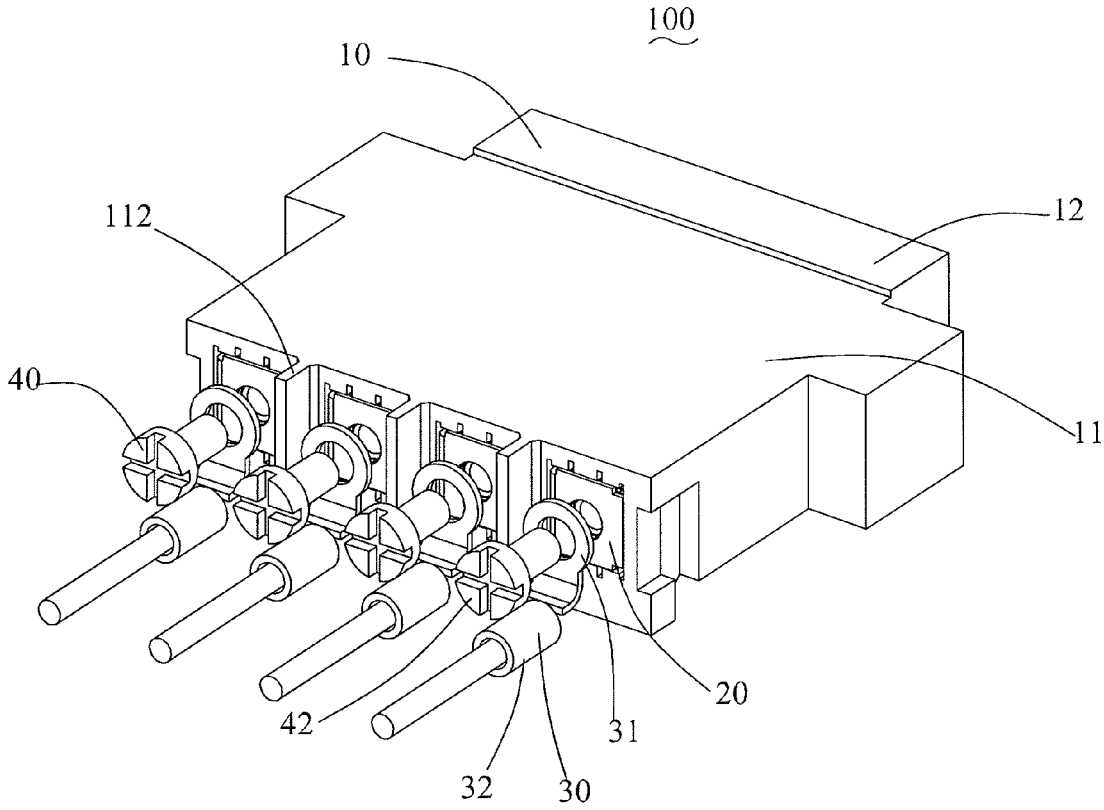
FIG. 2 is a partially exploded, perspective view of the cable end connector of FIG. 1.

Please refer to FIGS. 1-2, a cable end connector 100 in accordance with the present invention comprises an insulative housing 10, a plurality of conductive contacts 20 retained in the insulative housing 10, a plurality of cable terminals 30 respectively electrically connecting with the conductive contacts 20, a plurality of fastening members 40 mechanically connecting the conductive contacts 20 and the cable terminals 30, and a plurality of wires 50 respectively electrically connecting with the cable terminals 30. In the preferred embodiment of the present invention, the cable end connector 100 comprises four groups of conductive contacts 20, cable terminals 30, and fastening members 40. However, the number of the conductive contacts 20, the cable terminals 30 and the fastening members 40 is not only restricted to four, in alternative embodiments, the number could be variable.

Still referring to FIGS. 1-2, the insulative housing 10 comprises a main portion 11 and a mating portion 12 extending forwardly from the main portion 11. The insulative housing 10 defines a plurality of contact-receiving passages 101 penetrating the main portion 11 and the mating portion 12 for receiving the conductive contacts 20. Please specially refer to FIG. 4, each contact-receiving passage 101 comprises a first passage section 102 located in the mating portion 12 and a second passage section 103 located in the main portion 11. The width of the first passage section 102 is less than that of the second passage section 103. A partition wall 104 extends into the second passage section 103 to be adjacent to the first passage section 102.

A pair of rectangular recesses 105 is defined in opposite inner walls of the contact-receiving passage 101 to communicate with the second passage section 103 for retaining the conductive contact 20 into the insulative housing 10. It should be noted that the recess 105 also could be disposed in other locations in the contact-receiving passage 101 according to the shape of the conductive contact 20. Especially, a plurality of division walls 112 extend rearward from a rear face (not labeled) of the insulative housing 10. Each division wall 112 is located between two adjacent contact-receiving passages 101 for separating one conductive contact 20 from another to prevent potential short-circuit phenomenon.

Figure 3:
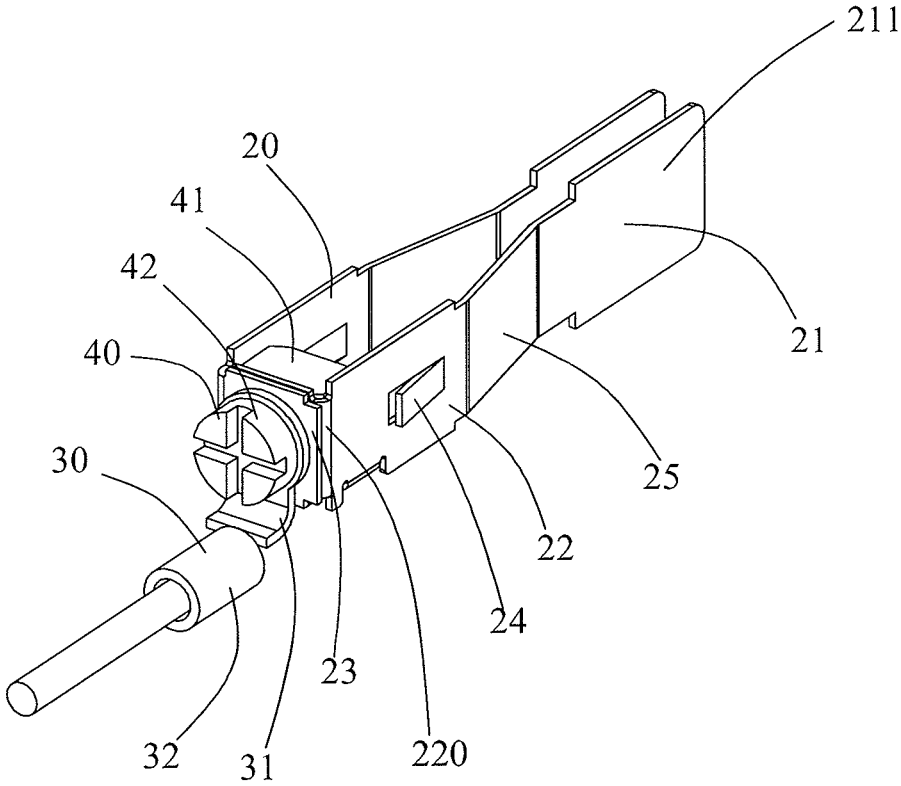
FIG. 3 is an assembled, perspective view of a conductive contact in accordance with the first embodiment of the present invention and a cable terminal with a cable.
Figure 4:
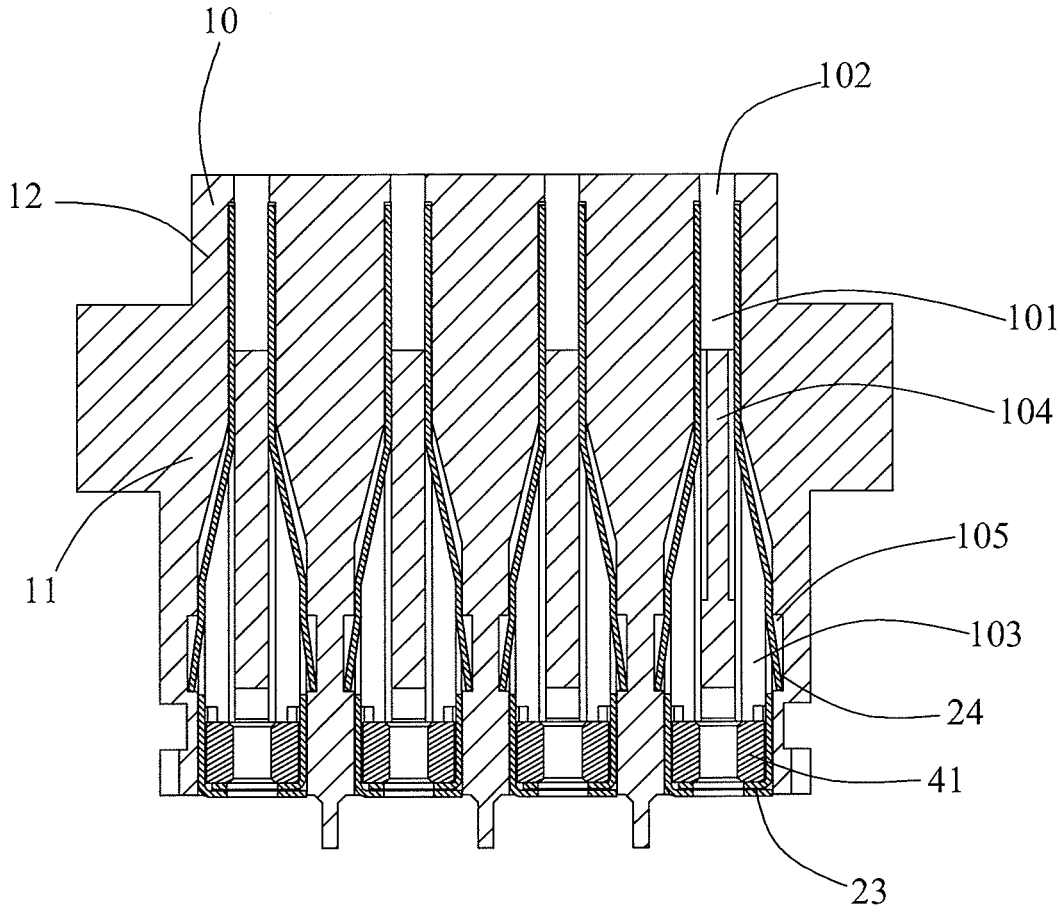
FIG. 4 is a cross-section view to show the assembled cable end connector, wherein the cable terminals are not shown.

In combination with FIGS. 3-4, one conductive contact 20, one cable terminal 30, one fastening member 40, and one wire 50 constitute a terminal group. The conductive contact 20 shown in FIG. 3 is in accordance with the first embodiment of the present invention. The conductive contact 20 is of substantially U-shape and comprises a contacting portion 21, a retaining portion 22 connecting with the contacting portion 21, and a locking portion 23 extending from the retaining portion 22. The contacting portion 21 comprises a pair of flat contacting pieces 211 extending substantially parallel to each other. The retaining portion 22 also includes a pair of sections respectively extending rearward from the contacting pieces 211 and forms a pair of bending sections 220 at free ends thereof. The pair of bending sections 220 bend toward each other and are folded together to form the locking portion 23. It should be pointed out that the conductive contact 20 in the preferred embodiment is of two-piece structure. However, in alternative embodiments, the conductive contact 20 also could be one-piece structure. Hence, the bottom of the U-shape conductive contact 20 forms the locking portion 23. A spring latch 24 is stamped on each section of the retaining portion 22. When the conductive contact 20 is inserted into the contact-receiving passage 101, the spring latch 24 locks in the recess 105 to retain the conductive contact 20 into the insulative housing 10. A through hole (not labeled) is defined in the locking portion 23 for cooperating with the fastening member 40. In addition, the conductive contact 20 also comprises an inclined connecting portion 25 connecting the contacting piece 211 with the retaining portion 22.

Please refer to FIG. 3 in combination with FIGS. 1-2, the cable terminal 30 comprises a fixing section 31 connecting with the locking portion 23 of the conductive contact 20, and a cable-connecting section 32 connecting with a corresponding wire 50. The fixing section 31 defines a through hole (no labeled) for the penetration of the fastening member 40. The cable-connecting section 32 is of column shape to crimp the wire 50. It should be understood that the detailed structures of the fixing section 31 and the cable-connecting section 32 could be configured according to different situations.

In the preferred embodiment of the present invention, the fastening member 40 comprises a screw cap 41 and a screw 42 cooperating with the screw cap 41. The screw 42 protrudes through the through hole of the fixing section 31 of the cable terminal 30, the through hole of the locking portion 23 of the conductive contact 20, then is screwed with the screw cap 41 which is received in the locking portion 23 to secure the cable terminal 30 with the conductive contact 20 reliably. Of course, the fastening member 40 also can utilize other fastening elements or fastening means. Any component which can mechanically combine the conductive contacts 20 and the cable terminals 30 should be regarded as the fastening member 40 of the present invention.

Figure 5:
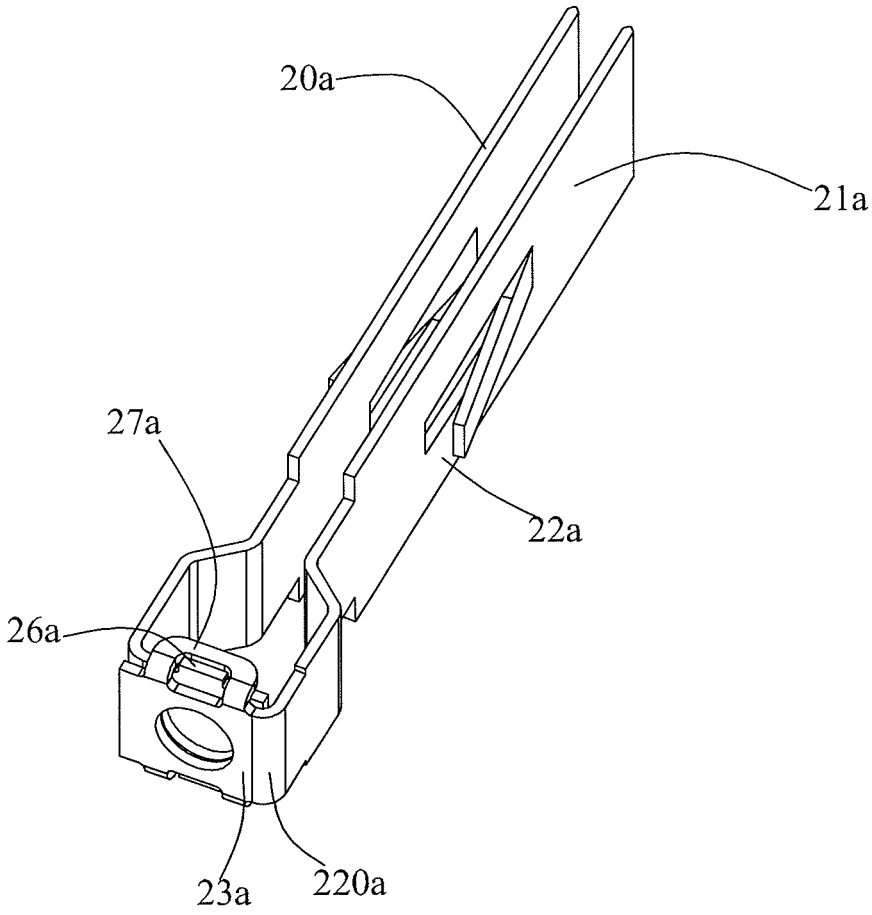
FIG. 5 is a perspective view of a conductive contact in accordance with the second embodiment of the present invention.

Please refer to FIG. 5, a conductive contact 20*a* in accordance with the second embodiment of the present invention also consists of two pieces. The conductive contact 20*a* comprises a pair of contacting pieces to form a contact portion 21*a* parallel to each other, a pair of retaining sections to form a retaining portion 22*a*, and a locking portion 23*a*. Similarly, the locking portion 23*a* is also folded by a pair of bending sections 220*a* of the retaining portion 22*a*. Especially, one bending section 220*a* forms a U-shape latch 27*a*, and the other bending section 220*a* forms a protrusion 26*a* latched with the latch 27*a* to secure the pair of bending sections 220*a* tightly.

Figure 6:
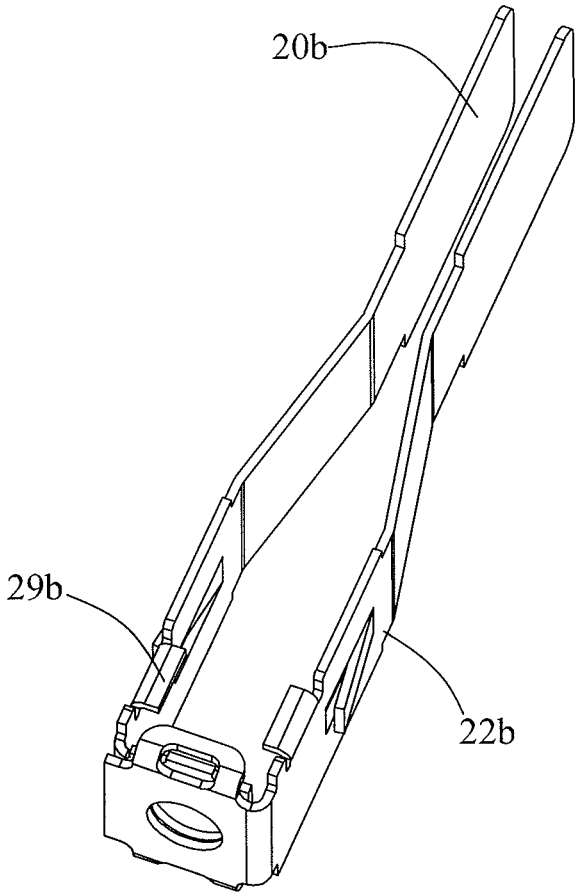
FIG. 6 is a perspective view of a conductive contact in accordance with the third embodiment of the present invention.

Please refer to FIG. 6, a conductive contact 20*b* in accordance with the third embodiment of the present invention has structure similar to that of the conductive contacts 22, 22*a*, thus only the differences will be introduced hereinafter. A pair of tabs 29*b* protrude inwardly from upper edges of the retaining portion 22*b* toward each other to restrict the screw cap 41 received in the conductive contact 20*b*.

In assembly, the screw cap 41 is put into the locking portion 23 of the conductive contact 20 firstly (Only the conductive contact 20 in accordance with the first embodiment is used as an example herein, the same theory should be common to the conductive contacts 20*a*, 20*b*). Then the conductive contact 20 together with the screw cap 41 is inserted into the contact-receiving passage 101 of the insulative housing 10 in back-to-front direction. The spring latches 24 are respectively received in the recesses 105 communicating with the contact-receiving passage 101 to retain the conductive contact 20 in the insulative housing 10. Then, the fixing section 31 of the cable terminal 30 aligns with the locking portion 23. Finally, the screw 42 of the fastening member 40 protrudes through the through hole of the fixing section 31, the through hole of the locking portion 23, then screwed with the screw cap 41.

In summary, the present invention utilizes screw fastening means to realize the combination between the conductive contacts 20 and the cable terminals 30, hence the cable terminals 30 are prevented from being pulled out from the conductive contacts 20. The reliability of the cable end connector 100 is increased, and the contacting area between the conductive contacts 20 and the cable terminals 30 is increased to decrease the impedance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. A cable end connector, comprising:

an insulative housing comprising a main portion and a mating portion extending forwardly from the main portion, the insulative housing defining a plurality of contact-receiving passages penetrating the main portion and the mating portion;

a plurality of conductive contacts received in the insulative housing and respectively received in the contact-receiving passages, each conductive contact comprising a contacting portion and a locking portion;

a plurality of cable terminals respectively electrically connecting with the locking portions of the conductive contacts;

a plurality of fastening members fastening the cable terminals with the conductive contacts; and a plurality of wires respectively electrically connecting with the cable terminals;

wherein the contacting portion of the conductive contact comprises a pair of contacting pieces parallel to each other;

wherein the conductive contact comprises a retaining portion extending rearward from each contacting piece, and wherein the retaining portion comprises a pair of retaining sections each forming a bending section at a free end thereof, and the pair of bending sections fold with each other to form the locking portion.

2. The cable end connector as claimed in claim 1, wherein each fastening member comprises a screw cap received in the locking portion of the conductive contact and a screw, and wherein the screw protrudes through the cable terminal, the locking portion of the conductive contact and is screwed with the screw cap to fasten the cable terminal and the conductive contact.

3. The cable end connector as claimed in claim 2, wherein the conductive contact forms at least one tab from side edge thereof adjacent to the locking portion to restrict the screw cap together with the locking portion.

4. The cable end connector as claimed in claim 1, wherein one of the folded bending sections forms a protrusion, and the other forms a latch to latch with said protrusion.

5. The cable end connector as claimed in claim 4, wherein the locking portion of the conductive contact and the cable terminal both define a through hole align with each other, and wherein the fastening member penetrate the through holes of the conductive contact and the cable terminal.

6. The cable end connector as claimed in claim 1, wherein the cable terminal comprises a cable-connecting section electrically connecting with the corresponding wire, and a fixing section connecting with the conductive contact, and wherein a through hole is defined in the fixing portion for the penetration of the fastening member, the cable-connecting portion is of column and grasps the wire to form the mechanical and electrical connection therebetween.

7. The cable end connector as claimed in claim 6, wherein the conductive contact is of U-shape and comprises the locking portion formed in the bottom thereof and a pair of contacting pieces parallel to each other, and wherein the pair of contacting pieces form the contacting portion.

8. The cable end connector as claimed in claim 1, wherein the conductive contact comprises a retaining portion connecting the locking portion and the contacting portion, and wherein the retaining portion is formed with at least one spring latch to be interferentially engaged with an inner wall of the contact-receiving passage to retain the conductive contact in the insulative housing.

9. The cable end connector as claimed in claim 1, wherein the contact-receiving passage comprises a first passage section defined in the mating portion, and a second passage section defined in the main portion, and wherein the width of the first passage section is less than that of the second passage section.

10. The cable end connector assembly as claimed in claim 9, wherein a partition wall is formed in the contact-receiving passage, and the fastening member comprises a screw cap and a screw, and wherein the screw cap is received between the partition wall of the insulative housing and the locking portion of the conductive contact, and the screw protrudes through the cable terminal, the locking portion to be screwed with the screw cap for fastening the conductive contact with the cable terminal.

* * * * *